United States Patent [19]

Håkansson

[11] 4,389,778

[45] Jun. 28, 1983

[54] DEVICE FOR KNIFE HANDLE

[75] Inventor: William Håkansson, Åmål, Sweden

[73] Assignee: Aktiebolaget Metka, Åmål, Sweden

[21] Appl. No.: 227,095

[22] PCT Filed: May 29, 1980

[86] PCT No.: PCT/SE80/00156

§ 371 Date: Dec. 17, 1980

§ 102(e) Date: Dec. 17, 1980

[87] PCT Pub. No.: WO80/02816

PCT Pub. Date: Dec. 24, 1980

[30] Foreign Application Priority Data

Jun. 29, 1979 [SE] Sweden ..... 7905049

[51] Int. Cl.[3] ..... B25G 3/28

[52] U.S. Cl. ..... 30/338; 30/339

[58] Field of Search ..... 30/338, 339, 342, 337, 30/329–336

[56] References Cited

U.S. PATENT DOCUMENTS

| | | | |
|---|---|---|---|
| 1,745,103 | 1/1930 | Lenze | 30/338 |
| 3,187,431 | 6/1965 | Mattes | 30/339 |
| 3,234,649 | 2/1966 | Preble et al. | 30/338 X |
| 3,367,335 | 2/1968 | Ward et al. | 30/339 X |
| 3,609,864 | 10/1971 | Bassett | 30/339 X |
| 3,626,592 | 12/1971 | LaCas et al. | 30/339 |

*Primary Examiner*—Frank T. Yost

*Attorney, Agent, or Firm*—Murray and Whisenhunt

[57] ABSTRACT

The invention relates to a device for a knife handle (3, 4) which is provided with a detachable knife blade (1). Fitted in the knife handle (3, 4) are spring members (6, 7) which engage securely with hooks (8, 9) in holes (10, 11) in the knife blade (1). The device according to the invention constitutes an easily handled release mechanism for the knife blade (1) and at the same time is so situated and constructed that it minimized the risk of accidental release of the knife blade. For this purpose, the device is distinguished by a control member (13) which is mounted at the opposite end of the handle (3, 4) to the knife blade (1) and is displaceable in the direction towards and away from the knife blade in the longitudinal direction thereof. The control member (13) is adapted, on displacement in the direction towards the knife blade (1) to penetrate in between the spring members (6, 7) and to bring their hooks (8, 9) out of engagement with the holes (10, 11) in the knife blade (1) and so to release the knife blade (1).

2 Claims, 7 Drawing Figures

DEVICE FOR KNIFE HANDLE

TECHNICAL FIELD

The present invention relates to a device for a knife handle which is provided with a detachable knife blade. More specifically, the invention relates to a device for those knife handles in which at least one spring member is fitted which is adapted to engage securely in a hole a countersinking or the like in the knife blade with at least one hook or the like.

BACKGROUND ART

Previously known knives constructed in the manner indicated above are intended primarily for cutting out carpets or for other work where the knife blade is exposed to severe wear. The idea in this case is that the knife blade can be of comparatively low quality if the securing in the knife handle is such that the blade only permits a cutting function. Usually the knife blade is mounted in the handle in such a manner that only a small cutting edge projects. The knife blade is then not exposed to such great flexural stresses and so does not risk breaking. These known knives are not suitable, however, for such fields of application as hunting, fishing, wood-carving etc. for example. The knife blade for these fields of application must be of good quality, have one or two long cutting edges and withstand chopping, stabbing, sawing and prizing loose. It is also important that the securing of the knife blade in the handle should be stable and free of play.

DISCLOSURE OF INVENTION

The object of the invention is to provide a device for knife blades which satisfies the requirements given above. More particularly, an object is to provide a knife suitable for example for hunting, fishing, wood-carving and the like, wherein the knife blade shall withstand chopping, stabbing, sawing and prizing loose, which presupposes that the securing of the knife blade in the handle is stable and free of play.

It is also an object of the invention to provide a device which permits a plurality of different types of knife blade which can be used, for example, for dismembering an animal killed while hunting.

Several different types of knife and chisel tool are likewise required for wood-carving. It therefore involves a considerable saving in carrying out the above-mentioned activities if, according to the invention, several different tools can be used with one and the same knife handle.

Thus through the invention a knife comes into existence with which the knife blade can easily and conveniently be detached from the handle and with which the knife blade is mounted firmly and securely in the inserted position, while at the same time the risk of the knife blade accidentally coming loose is minimum. That which primarily distinguishes the device according to the invention can be seen from claim 1. Further characteristics of the invention are seen from the following description and the other patent claims.

BRIEF DESCRIPTION OF DRAWINGS

The invention will be explained in more detail below with reference to an example of embodiment which is shown on the accompanying drawings in which

FIG. 2 with the knife blade locked in the handle, FIG. 4 with the control member pressed in releasing the knife blade and FIG. 6 the knife handle without knife blade.

BEST MODE OF CARRYING OUT THE INVENTION

Figure 1:
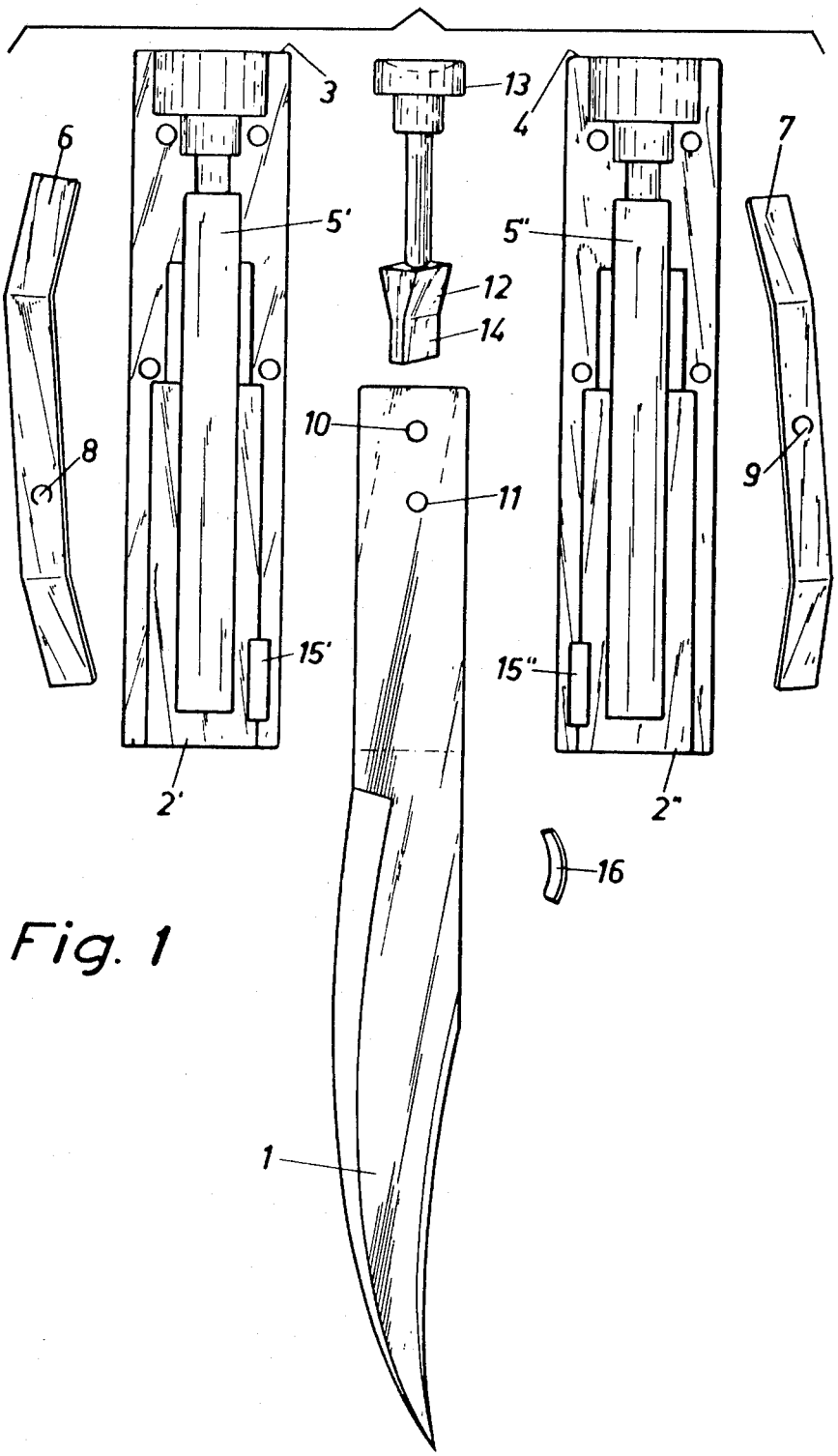
FIG. 1 is an exploded view of the parts included in the device.

The device includes a knife blade 1 which is adapted to be introduced into a slide 2 formed from recesses 2', 2'' in two halves 3, 4 of gripping members. The halves of gripping members are identical in shape but in mirror image and together form a knife handle.

Disposed in each half gripping member 3, 4 is a groove 5', 5'' which grooves together form a chamber 5. A spring leaf 6, 7 is disposed in each groove 5', 5''. The leaves have their resilient contact surface facing one another.

The spring leaves 6, 7 are each provided with a hook 8, 9 on the contact surface which hooks are directed from the opening of the slide 2 obliquely into the slide space.

Figure 2:
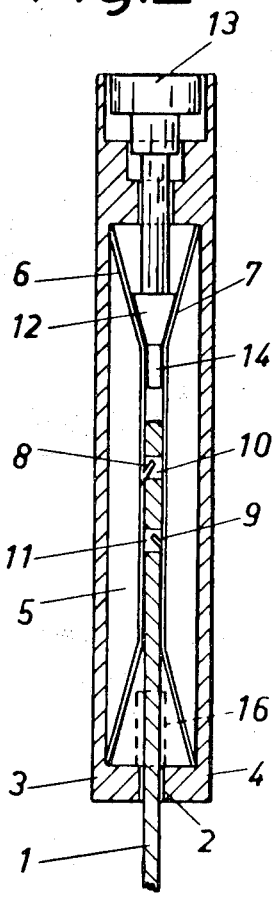
FIGS. 2–7 show the device in longitudinal and cross section in three different positions.

The knife blade 1 is provided with holes 10, 11, countersinkings or the like in which the hooks 8, 9 are situated when the knife blade is fully introduced into the handle, see FIG. 2.

The spring leaves 6, 7 are bent outwards at both ends, at the outer end to facilitate the introduction of the knife blade 1 between the spring leaves and at the inner end to permit the introduction of a wedge 12 which constitutes the innermost portion of a control member 13.

Figure 4:
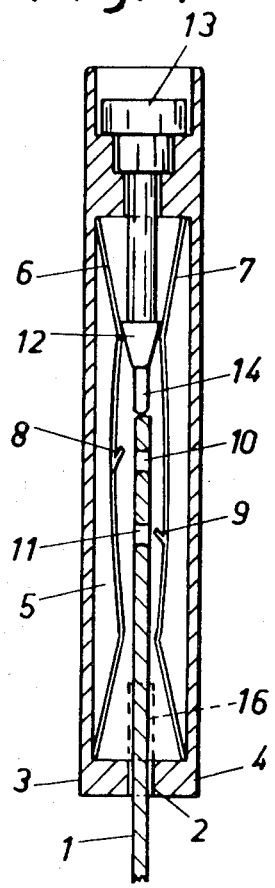
Figure 6:
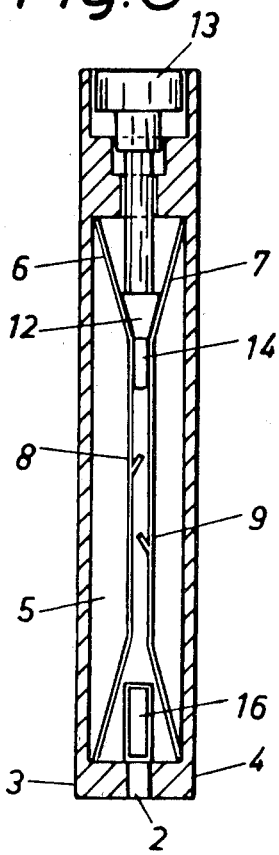
Figure 3:
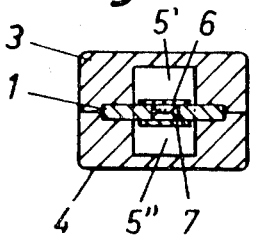
Figure 5:
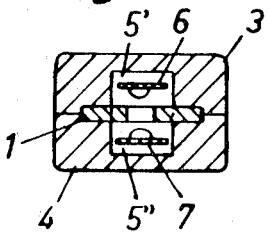
Figure 7:
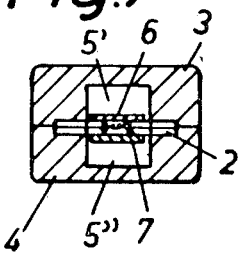

The control member 13 is placed in the back portion of the knife handle, countersunk to the level of the back end of the handle and is displaceable in the direction towards and away from the knife blade 1 in its longitudinal direction. On displacement in the direction towards the knife blade 1, the wedge 12 of the control member 13 penetrates between the two spring leaves 6, 7 and brings their hooks 8, 9 out of engagement with the knife blade, see FIG. 4. So long as the control member 13 is kept pressed in, therefore, the knife blade 1 can easily be pulled out of the handle.

The wedge 12 may appropriately be provided with an extension 14 by means of which, through maximum pressing in of the control member 13, the knife blade 1 can be pushed out a short distance so that the hooks 8, 9 may no longer be situated in front of their respective holes 10, 11. In this case, it is possible to pull out the knife blade 1 even after the control member 13 has been released.

It is also possible to arrange the hooks 8, 9 and holes 10, 11 in line with one another at a distance from one another which corresponds to the distance which the knife blade is displaced on maximum pressing in of the control member 13. In this case, the hole 10 is displaced from the position opposite the hook 9 to a position opposite the hook 8 which means that the knife blade 1 is again mounted securely in a somewhat projecting position after the control member 13 has been released. This arrangement gives an extra security against the accidental detachment of the knife blade in addition to the security which is provided on the one hand by the countersunk placing of the control member in the handle and on the other hand by the working movement of the control member in the longitudinal direction of the handle and the knife blade.

Mounted in a cavity which is formed by two recesses 15', 15'' at the side of the knife blade 1 when the gripping member halves 3, 4 are assembled is an extra spring leaf 16 which bears against the knife blade 1 and is adapted to prevent play between the knife blade and the handle.

The invention is not restricted to the embodiment shown and described but a number of modifications are conceivable within the scope of the following claims. Both the spring leaves 6, 7 and the control member 13 and the hooks 8, 9 can be formed otherwise than shown.

I claim:

1. A knife handle capable of firmly holding a detachable knife blade having a substantially flat side with a set of openings therein, said handle comprising two spring leaf means for bearing against the flat side of said knife blade, said spring leaf means having protrusions which engage the set of openings in said knife blade, said openings corresponding to the positions of said protrusions, said knife handle including control means for applying pressure between said spring leaf means to disengage said protrusions from said corresponding knife blade openings, wherein said control means includes a wedge means displaceable in said handle for forcing apart said spring leaf means, wherein the maximum displacement of said wedge means displaces said knife blade in a direction parallel to the displacement of said wedge means to leave said knife blade openings in a position which does not correspond to said protrusions.

2. A knife handle capable of firmly holding a detachable knife blade having a substantially flat side with a set of openings therein, said handle comprising two spring leaf means for bearing against the flat side of said knife blade, said spring leaf means having protrusions which engage the set of openings in said knife blade, said openings corresponding to the positions of said protrusions, said knife handle including control means for applying pressure between said spring leaf means to disengage said protrusions from said corresponding knife blade openings, wherein said control means includes a wedge means displaceable in said handle for forcing apart said spring leaf means, wherein said knife blade is displaceable in said handle in a direction corresponding to the direction of said wedge means, said openings in said knife blade being in line with one another along such direction, and the maximum displacement of said wedge means causes an equal displacement of said knife blade in said handle to cause a given opening to be displaced from a position generally opposite a given protrusion to a second position generally opposite a second protrusion.

* * * * *